US006853891B2

(12) United States Patent
Hasler et al.

(10) Patent No.: US 6,853,891 B2
(45) Date of Patent: Feb. 8, 2005

(54) LOW SPEED SHIFT STRATEGY FOR MARINE ENGINES

(75) Inventors: Gregory S. Hasler, Pekin, IL (US); David L. Zwetz, II, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 10 days.

(21) Appl. No.: 10/256,655

(22) Filed: Sep. 27, 2002

(65) Prior Publication Data

US 2004/0064224 A1 Apr. 1, 2004

(51) Int. Cl.[7] ..... B60L 11/00

(52) U.S. Cl. ..... 701/21

(58) Field of Search ..... 701/21, 99, 100; 440/21, 1, 12.62; 340/984

(56) References Cited

U.S. PATENT DOCUMENTS 6,132,267 A * 10/2000 Campbell ..... 440/6
6,379,114 B1 * 4/2002 Schott et al. ..... 416/1

* cited by examiner

*Primary Examiner*—Yonel Beaulieu
(74) *Attorney, Agent, or Firm*—Cliff G Green; Leill & McNeil

(57) ABSTRACT

Apparatuses and methods for controlling the engine speed of an engine. A throttle receives an operator input indicative of a desired engine speed. A first sensor is coupled with the throttle, and transmits a throttle signal indicative of a position of the throttle. A minimum speed governor is coupled with the first sensor to receive the throttle signal. The minimum speed governor determines a rate of change of the throttle signal, and transmits a minimum engine speed signal indicative of a desired minimum engine speed of the engine as a function of the rate of change of the throttle signal.

13 Claims, 2 Drawing Sheets

2/2

START
50
52
INITIAL ENGINE SPEED > THRESHOLD ?
NO
YES
54
THROTTLE RATE OF CHANGE = RAPID SHIFT ?
NO
YES
56
SET MIN ENGINE SPEED TO 700 RPM
58
HAS ENGINE SPEED STARTED TO RECOVER ?
NO
YES
62
HAVE ___ SECONDS ELAPSED ?
NO
YES
60
REMOVE MIN ENGINE SPEED LIMIT
FINISH

LOW SPEED SHIFT STRATEGY FOR MARINE ENGINES

TECHNICAL FIELD

This invention relates generally to the control of engines, and more specifically to the low speed shift strategy of marine engines.

BACKGROUND

An abnormally high load may be placed on a marine engine when a marine vessel is travelling forward at a high rate of speed and is rapidly shifted into reverse gear. This is because the momentum of the vessel remains in the forward direction for a brief period of time. This forward momentum typically urges the vessel's propeller to continue spinning in the direction that it was spinning prior to the shift into reverse gear.

When the engine is in reverse gear, however, the engine attempts to drive the propeller in the opposite direction. The momentum of the vessel thus places a load on the propeller, which is transferred back to the engine via a drive shaft. The load is generally proportional to the speed of the vessel and the quickness of the shift from forward to reverse gear. Generally, lowering the speed of the vessel or slowing the duration of the shift allows the vessel to be travelling more slowly when the shift into reverse occurs, with a proportionally lower load being placed on the propeller.

Further exacerbating the situation, in reverse gear the range of engine speeds available may be relatively low, meaning that a relatively small amount of power is provided by the engine to overcome any loading. In some situations, when this small amount of power tries to overcome the load on the engine, the engine speed may drop below a minimum desired engine speed, causing, for example, lugging of the engine, which is generally undesirable.

SUMMARY OF THE INVENTION

The present invention provides apparatuses and methods for controlling the engine speed of an engine. A throttle receives an operator input indicative of a desired engine speed. A first sensor is coupled with the throttle, and transmits a throttle signal indicative of a position of the throttle. A minimum speed governor is coupled with the first sensor to receive the throttle signal. The minimum speed governor determines a rate of change of the throttle signal, and transmits a minimum engine speed signal indicative of a desired minimum engine speed of the engine as a function of the rate of change of the throttle signal.

DETAILED DESCRIPTION

Figure 1:
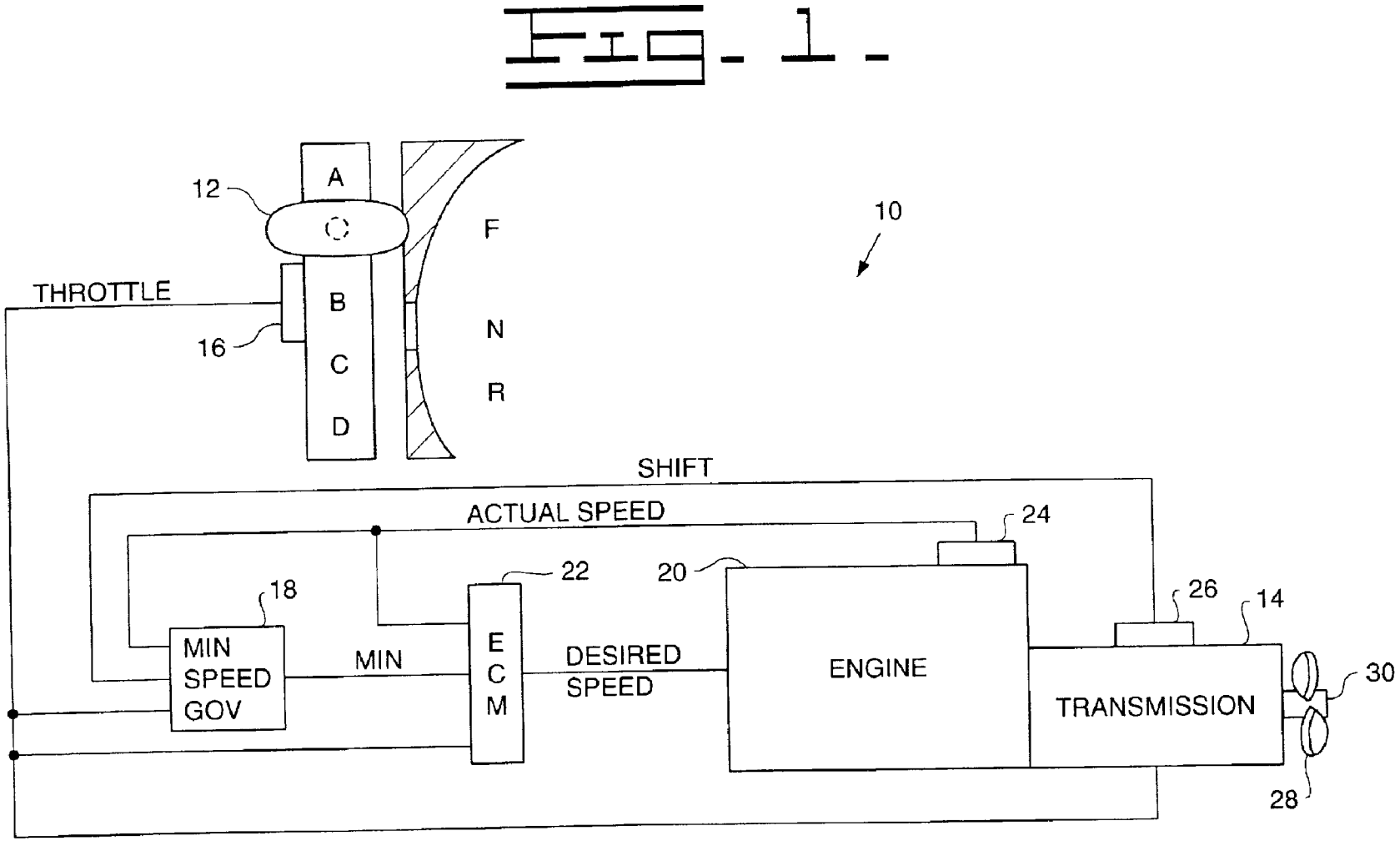
FIG. 1 is a functional block diagram of an engine speed control system according to one embodiment of the invention.

FIG. 1 is a functional block diagram of an engine control system 10 according to one embodiment of the invention. The engine control system typically includes a throttle 12, such as a lever arm that may be moved by the hand of an operator. Other types of throttles known to those skilled in the art may also be used. For example, foot pedals or dials could be substituted for the lever arm. Typically the throttle 12 is capable of moving through a range of positions indicative of a respective desired engine speed, or in some cases, desired engine torque.

The words "indicative of" are intended to include both direct and indirect indications of the respective quality, and may be generally thought of as including characteristics which have a known relationship with the quality at issue. For example, the frequency at which an intake valve opens is typically indicative of the engine speed of an engine.

The position of the throttle 12 may also be indicative of a desired gear for a transmission 14, such as forward, neutral, or reverse. Forward and/or reverse gear may be a single respective gear, or several gears, such as first gear, second gear, third gear, etc. for forward and/or reverse. For purposes of illustration only, the throttle 12 is depicted as having a single forward gear and a single reverse gear, with full forward being when the throttle is at point A, e.g., the highest desired/commanded engine speed or torque in forward gear, minimum forward being at point B, e.g., the lowest commanded/desired engine speed or torque in forward gear. Similarly, minimum reverse, e.g., the lowest commanded/desired engine speed, occurs when the throttle 12 is at point C, and full reverse, e.g., the highest commanded/desired engine speed or torque in reverse gear, occurs at point D.

A first sensor 16, is coupled with the throttle 12 to transmit a throttle signal ("THROTTLE") indicative of a position of the throttle 12 by ways known to those skilled in the art. The word "coupled" is intended to include both direct and indirect connection, with the connection being physical, electrical, magnetic, or any other type of relationship that allows cause and effect. The throttle signal THROTTLE is typically an electrical signal, although a mechanical signal, e.g., the position of a wire, or other types of signals known to those skilled in the art could also be used.

In some embodiments of the invention, not shown, the throttle 12 may be separated into two devices: one to indicate a desired engine speed/torque, and one to indicate a desired gear (e.g., forward or reverse). For illustrative purposes only, however, the more common configuration of FIG. 1 is shown. The throttle signal THROTTLE described herein may be thought of as including both aspects, or not, as appropriate.

A minimum speed governor 18 may be coupled with the throttle 12 to receive the throttle signal THROTTLE. The minimum speed governor 18 may be operable to determine a rate of change of the throttle signal THROTTLE, and to transmit a minimum engine speed signal ("MIN") indicative of a desired minimum engine speed of an engine 20 as a function of the rate of change of the throttle signal THROTTLE. In other embodiments of the invention, the minimum engine speed signal may be indicative of a minimum engine torque. However, because in most applications, torque is a function of engine speed, for simplicity an engine speed signal may be considered to cover an engine torque signal too.

The minimum speed governor 18 effectively operates in at least two modes. The first mode, e.g., inactive mode, is typically the default mode. In inactive mode, the minimum speed governor 18 either transmits the minimum engine speed signal MIN that corresponds to no minimum limit, or effectively transmits no signal, e.g., transmits zero volts or zero current. The second mode, e.g., active mode, is triggered generally when the rate of change of the throttle signal THROTTLE exceeds a predetermined magnitude in a predetermined direction. Additional requirements for triggering, such as a minimum actual engine speed, described below, may also be used. In the active mode, the minimum speed governor 18 typically transmits the minimum engine speed signal MIN corresponding to a desired minimum engine speed.

As mentioned above, the active mode may be triggered in part by when the rate of change of the throttle signal THROTTLE exceeds a predetermined magnitude. Generally, the predetermined magnitude may be a matter of choice. In embodiments of the invention, the predetermined magnitude may generally be a large enough magnitude to indicate that a rapid change in engine speed has been requested. In some embodiments of the invention, a rate of change of the throttle signal THROTTLE corresponding to a desired rate of change of engine speed of about about 800 r.p.m. per second, or a rate of change of the actual engine speed of about 800 r.p.m. per second, would be sufficient to meet the predetermined magnitude. In other embodiments, different numbers may be used. For purposes of discussion, a change in the requested engine speed, e.g., a change in the throttle signal THROTTLE, that meets these requirements will be described as a "rapid shift".

The active mode may also be triggered in part by the rate of change of the throttle signal THROTTLE being in a predetermined direction. For example, the throttle signal may be thought of as 5 volts representing full forward (point A), 2 volts for minimum forward (point B), −2 volts for minimum reverse (point C), and −5 volts for full reverse. In this example, the predetermined direction may be a throttle signal that is becoming more negative (the direction being towards a magnitude that is less positive/more negative), e.g., 4 volts to 1 volt, 3 volts to −2 volts, or −1 volts to −4 volts. In some embodiments of the invention, the predetermined direction is the direction that indicates the throttle 12 is moving towards full reverse (point D). In other embodiments of the invention, the predetermined direction of the throttle signal THROTTLE may be just the opposite: a direction indicative of the throttle 12 moving towards full forward (point A).

The desired minimum engine speed typically depends on the particular engine 20 and transmission 14 being used, and may be determined by ways known to those skilled in the art. Again, the desired minimum engine speed may be a matter of choice. In some embodiments of the invention, the desired minimum engine speed may be about 700 r.p.m. In some embodiments of the invention, the desired minimum engine speed may correspond to an engine speed that is operable to prevent lugging or some degree of a drop (0–100%) in engine speed when a rapid shift from forward to reverse occurs when the marine vessel is moving forward at a relatively high rate of travel. Further, the desired minimum engine speed typically corresponds to an engine speed in excess of the current engine speed being commanded from the throttle 12.

In some embodiments of the invention, the minimum speed governor 18 may also receive an actual engine speed signal ("ACTUAL SPEED") indicative of an actual speed of the engine, and/or a shift signal (SHIFT") indicative of a whether a shift in the gears of the transmission 14 has occurred. In some embodiments of the invention, the actual engine speed signal ACTUAL SPEED may be used as a required element for triggering the active mode of the minimum speed governor 18. In these embodiments, typically the active mode would not trigger unless the actual engine speed signal ACTUAL SPEED indicated that an initial engine speed, e.g., an engine speed prior to the time when the rate of change of the throttle signal THROTTLE exceeds the predetermined magnitude in a predetermined direction, is above a predetermined value. This predetermined value may be a matter of choice, and may be chosen to be large enough to indicate that, for example, the vessel speed is likely to be significant. Alternately, the vessel speed may be used directly as a triggering requirement: the vessel speed must exceed some threshold in order to trigger the active mode.

In some embodiments of the invention, the actual engine speed signal ACTUAL SPEED may be used instead of the throttle signal THROTTLE to trigger when the minimum engine speed signal MIN is transmitted by the minimum speed governor 18. This may allow for a quicker response by the minimum speed governor 18, because in many instances, the engine speed will lag the throttle signal THROTTLE by some amount of time.

An engine control module 22 may be coupled with the minimum speed governor 18 to receive the minimum engine speed signal MIN, and with the first sensor 16 to receive the throttle signal THROTTLE. The engine control module transmits a desired/commanded engine speed signal ("DESIRED SPEED") to the engine 20 as a function of the minimum engine speed signal MIN and the throttle signal THROTTLE.

Typically, the desired engine speed signal DESIRED SPEED does not account for the minimum engine speed signal MIN unless the minimum engine speed signal MIN indicates that a minimum engine speed is desired that exceeds the engine speed that corresponds to the throttle signal THROTTLE. When the latter situation exists, the engine control module 22 transmits a desired/commanded engine speed that corresponds, e.g., is equal to, the engine speed corresponding to the minimum engine speed signal MIN. Otherwise the engine control module 22 may transmit the desired engine speed signal DESIRED SPEED as a function of the throttle signal THROTTLE by any of a variety of ways known to those skilled in the art.

In some embodiments of the invention, a second sensor 24 may be coupled with the engine 20 to transmit the actual engine speed signal ACTUAL SPEED by any of a variety of ways known to those skilled in the art. Typically this may be achieved by sensing the number of rotations of a flywheel (not shown) of the engine 20, but other ways, such as monitoring the opening or closing of engine valves, cylinder pressures, cylinder temperatures, etc. could also be used. The engine control module 22 may also receive the actual engine speed signal ACTUAL SPEED and use it by ways known to those skilled in the art to affect the desired engine speed signal DESIRED SPEED, e.g., to run closed-loop.

In embodiments of the invention that use the second sensor 24, the engine control module may use predictive logic, by ways known to those skilled in the art, to determine when the actual engine speed appears likely to drop below the minimum engine speed that corresponds to the minimum engine speed signal MIN. This may allow the engine control module 22 to command more fuel to be sent to the engine 20 or otherwise compensate for the anticipated drop in engine speed below the desired minimum engine speed before it occurs.

In some embodiments of the invention, the transmission 14 may be coupled with the engine to receive the power generated by the engine by ways known to those skilled in the art. The transmission 14 functions by ways known to those skilled in the art, and will not be described further in the interest of brevity.

In some embodiments of the invention, a third sensor 26 may be coupled with the transmission 14. The third sensor transmits the shift signal SHIFT mentioned above by any of a variety of ways known to those skilled in the art. For example, the third sensor may monitor the gear position of the transmission, or the oil pressure within a lock-up clutch or elsewhere within the transmission. In the latter situation, the pressure generally drops while a gearshift is in progress, and raises when the new gear is engaged. Since many transmissions do not include a sensor that monitors the gear that the transmission is in, the oil pressure configuration mentioned above may be more desirable.

A propeller 28 or other propulsion device, e.g., jet or turbine, may be coupled, such as by a shaft 30, with the transmission 14 or directly to the engine 20 to receive the power generated by the engine 20. The propeller 28 functions in ways known to those skilled in the art.

Although the minimum speed governor 18 is shown preceding the engine control module 22, in some embodiments of the invention, the minimum speed governor 18 may be located after the engine control module 22. In these embodiments, the minimum speed governor 18 would typically receive the commanded engine speed signal DESIRED SPEED from the engine control module 22. The minimum speed governor 18 could then act as an override on a desired engine speed signal DESIRED SPEED if the engine speed corresponding to the desired engine speed signal DESIRED SPEED were less than the engine speed corresponding to the minimum engine speed signal MIN.

Although the minimum engine speed governor 18 is depicted as being physically separate from the engine control module 22, it need not be so. Instead, the governor 18 may be integrated with the engine control module 22, or with other functional components shown in FIG. 1.

Once triggered, it is typically not desirable for the minimum speed governor 18 to continuously operate in the effective active mode, described above. In some embodiments of the invention, the minimum speed governor 18 will switch from active mode back to the inactive mode when the actual engine speed begins to increase after the rapid shift occurs. This may be determined by monitoring the actual engine speed, e.g., the actual engine speed signal ACTUAL SPEED. In other embodiments of the invention, this switch back may occur after a predetermined amount of time has elapsed since the rapid shift occurred, or since the shift in gears within the transmission has occurred, as reflected by the shift signal SHIFT. This amount of time is a matter of choice, but in some embodiments is on the order of about 1–5 seconds.

Figure 2:
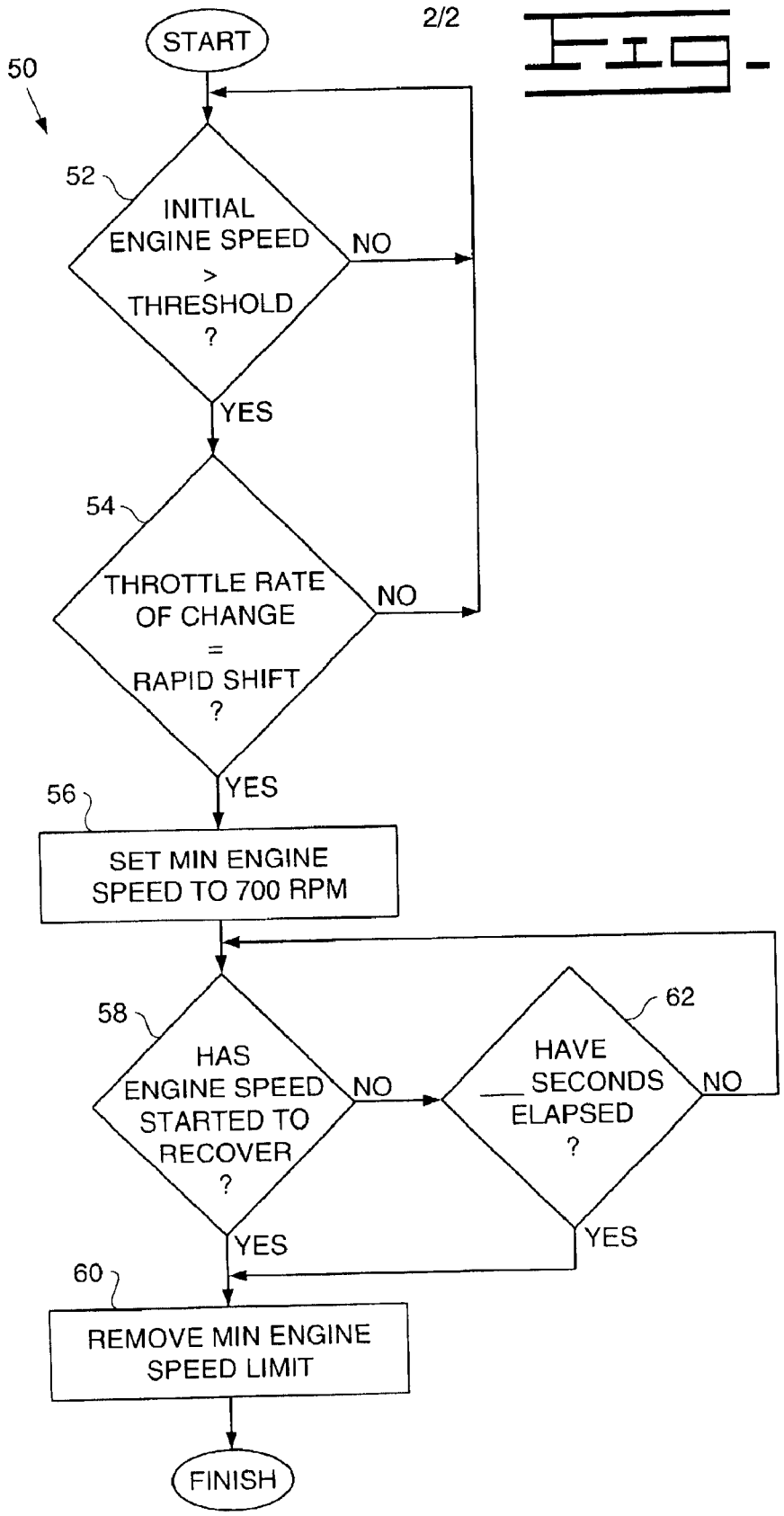
FIG. 2 shows a flowchart according to one embodiment of the invention.

FIG. 2 shows a flowchart 50 according to one embodiment of the invention. In box 52, the initial engine speed, e.g., the engine speed prior to a rapid shift, is compared with a predetermined value, e.g., a threshold. If the engine speed exceeds the predetermined value, control passes to block 54. Otherwise control remains in block 52.

In block 54, the rate of change of the position of the throttle 12 is compared to the predetermined magnitude in the predetermined direction. If the rate of change exceeds the predetermined magnitude in the predetermined direction, i.e., a rapid shift has occurred, control passes to block 56. Otherwise control passes to block 52.

In block 56 the minimum engine speed for the engine 12 is set to 700 r.p.m. Control then passes to block 58.

In block 58 it is determined whether the engine speed has begun to recover, e.g., increase, after the rapid shift has occurred. If it has, control passes to block 60. If not, control passes to block 62.

In block 60, the minimum engine speed limit set in block 56 is removed.

In block 62, it is determined whether a predetermined amount of time has elapsed since the rapid shift has occurred. If it has, control passes to block 60. If it has not, control passes to block 58.

Industrial Applicability

The engine control system 10 may be used to avoid lugging conditions in marine engines on vessels that are travelling at a relatively high rate of speed and then perform a rapid shift, for example, into reverse gear. Normally the marine vessel would likely experience a drop in engine speed if the vessel's momentum applies a load to the propeller 28 opposing and perhaps in excess of the force applied to the propeller from the engine 12. However, the engine control system 10 may be configured to set a relatively high minimum engine speed, e.g., 700 r.p.m., when a rapid shift occurs. This is typically an elevated setting from the normal minimum engine speed of, for example, 550 r.p.m., that most engines have to prevent stalling. The elevated minimum engine speed causes a larger force to be applied to the propeller 28, thereby reducing or eliminating the drop in engine speed due to the load from the vessel's momentum.

Additional triggering requirements, such as a minimum engine or vessel speed may also be set. Setting of these characteristics may be selected based on the degree of loading on the propeller 28 that the engine 20 is able to handle without experiencing a significant drop in engine speed. That is, a vessel or engine speed below some level may not be sufficient to cause a significant loading of the propeller 28.

After the elevated minimum engine speed is set, the engine control system 10 reverts to its normal minimum engine speed if either the engine speed begins to increase, indicating that the engine 20 has begun to recover and counter the loading on the propeller 28, or a certain amount of time has passed. The amount of time is chosen so that under most circumstances, the loading on the engine 20 from the propeller has been reduced, eliminated, or compensated for by the engine 20.

From the foregoing it will be appreciated that, although specific embodiments of the invention have been described herein for purposes of illustration, various modifications may be made without deviating from the spirit or scope of the invention. Accordingly, the invention is not limited except as by the appended claims.

What is claimed is:

1. An apparatus for controlling the engine speed of an engine, comprising:

a throttle operable to receive an operator input indicative of a desired engine characteristic;

a first sensor coupled with one of the throttle and the engine, the first sensor operable to transmit a first signal indicative of an engine speed;

a minimum speed governor coupled with the first sensor to receive the first signal, the minimum speed governor operable to determine a rate of change of the first signal, and to transmit a minimum engine speed signal indicative of a desired minimum engine speed of the engine as a function of the rate of change of the first signal, said minimum speed governor is operable to transmit the minimum engine speed signal when the rate of change of the first signal exceeds a predetermined magnitude in a predetermined direction, wherein the predetermined magnitude comprises substantially a change in engine speed of 800 r.p.m. per second.

2. The apparatus of claim 1 wherein minimum speed governor is coupled with the engine to receive an actual engine speed signal indicative of an actual engine speed of the engine, the minimum speed governor being operable to transmit the minimum engine speed signal as a function of the rate of change of the first signal and an initial engine speed being greater than a second predetermined value, the initial engine speed being an engine speed prior to the time when the rate of change of the first signal exceeds a predetermined magnitude in a predetermined direction.

3. The apparatus of claim 1, further comprising:

a vessel speed sensor operable to transmit a vessel speed signal indicative of a speed of a vessel using the engine for propulsion;

wherein minimum speed governor is coupled with the vessel speed sensor to receive the vessel speed signal, the minimum speed governor being operable to transmit the minimum engine speed signal as a function of the rate of change of the first signal and an initial vessel speed being greater than a second predetermined value, the initial vessel speed being a vessel speed prior to the time when the rate of change of the first signal exceeds a predetermined magnitude in a predetermined direction.

4. The apparatus of claim 1 wherein the first signal is indicative of an actual engine speed of the engine; and wherein the minimum engine speed governor is operable to transmit the minimum engine speed signal indicative of the desired minimum engine speed of the engine at least until the first signal indicates that the actual engine speed has begun to increase.

5. The apparatus of claim 1 wherein the first sensor is operable to transmit the first signal indicative of the position of the throttle, further comprising:

a second sensor coupled with the engine, the second sensor operable to transmit an actual engine speed signal indicative of an actual engine speed of the engine; and wherein the minimum engine speed governor is operable to transmit the minimum engine speed signal indicative of the desired minimum engine speed of the engine at least until the actual engine speed signal indicates that the actual engine speed has begun to increase.

6. A method for controlling the engine speed of an engine, comprising:

determining a rate of change of a throttle command from an first throttle command to a second throttle command; and limiting the desired engine speed to at least a first predetermined value when the rate of change of the throttle command exceeds a predetermined magnitude in a predetermined direction, wherein the predetermined magnitude comprises a magnitude corresponding to a rate of change of the engine speed of about 800 r.p.m. per second.

7. The method of claim 6 wherein limiting the engine speed to at least a first predetermined value comprises limiting the desired engine speed to at least the first predetermined value when the rate of change of the throttle command exceeds a predetermined magnitude in a predetermined direction; and an initial engine speed is greater than a second predetermined value, the initial engine speed being an engine speed prior to the time when the rate of change of the throttle command exceeds the predetermined magnitude in the predetermined direction.

8. The method of claim 6 wherein the engine is operable to propel a marine vessel;

wherein limiting the desired engine speed to at least a first predetermined value comprises limiting the desired engine speed to at least the first predetermined value when the rate of change of the throttle command exceeds a predetermined magnitude in a predetermined direction; and an initial vessel speed is greater than a second predetermined value, the initial vessel speed being a vessel speed prior to the time when the rate of change of the throttle command exceeds the predetermined magnitude in the predetermined direction.

9. The method of claim 6, further comprising:

monitoring an actual engine speed of the engine; and wherein limiting the desired engine speed to at least a first predetermined value comprises limiting the desired engine speed to predetermined value at least until the actual engine speed begins to increase.

10. A method for controlling the engine speed of an engine, comprising:

determining a rate of change of an actual engine speed from a first engine speed to a second engine speed; and limiting the desired engine speed to at least a first predetermined value when the rate of change of the actual engine speed exceeds a predetermined magnitude in a predetermined direction, wherein the predetermined magnitude comprises a magnitude corresponding to a rate of change of the engine speed of about 800 r.p.m. per second.

11. The method of claim 10 wherein limiting the desired engine speed to at least a first predetermined value comprises limiting the desired engine speed to at least the first predetermined value when the rate of change of the actual engine speed exceeds a predetermined magnitude in a predetermined direction; and an initial engine speed is greater than a second predetermined value, the initial engine speed being an engine speed prior to the time when the rate of change of the actual engine speed exceeds the predetermined magnitude in the predetermined direction.

12. The method of claim 10 wherein the engine is operable to propel a marine vessel;

wherein limiting the desired engine speed to at least a first predetermined value comprises limiting the desired engine speed to at least the first predetermined value when the rate of change of the actual engine speed exceeds a predetermined magnitude in a predetermined direction; and an initial vessel speed is greater than a second predetermined value, the initial vessel speed being a vessel speed prior to the time when the rate of change of the actual engine speed exceeds the predetermined magnitude in the predetermined direction.

13. The method of claim 10, further comprising:

monitoring an actual engine speed of the engine; and wherein limiting the desired engine speed to at least a first predetermined value comprises limiting the desired engine speed to predetermined value at least until the actual engine speed begins to increase.

* * * * *